US010011037B2

(12) United States Patent
Wang

(10) Patent No.: US 10,011,037 B2
(45) Date of Patent: Jul. 3, 2018

(54) SELECTIVELY ADJUSTABLE HEEL MEMBER FOR A PUSH BLOCK AND A PUSH BLOCK WITH THE SAME

(71) Applicant: MICRO JIG, INC., Winter Springs, FL (US)

(72) Inventor: Henry Wang, Winter Springs, FL (US)

(73) Assignee: Henry Wang, Winter Springs, FL (US)

( * ) Notice: Subject to any disclaimer, the term of this patent is extended or adjusted under 35 U.S.C. 154(b) by 1116 days.

(21) Appl. No.: 14/252,376

(22) Filed: Apr. 14, 2014

(65) Prior Publication Data

US 2015/0290832 A1 Oct. 15, 2015

(51) Int. Cl.
*B27B 25/10* (2006.01)

(52) U.S. Cl.
CPC ..... *B27B 25/10* (2013.01)

(58) Field of Classification Search
CPC ..... B27B 25/00; B27B 25/10; B27B 27/00; B27B 29/00; B27C 5/02; B27C 5/04; B27C 5/06; Y10T 409/309184; Y10T 409/30924
USPC ..... 83/436.2; 144/242.1, 245.1, 245.6, 144/250.23, 253.1, 253.6, 253.8, 253.9
See application file for complete search history.

(56) References Cited

U.S. PATENT DOCUMENTS 2,839,100 A 6/1958 Valicenti
4,370,909 A * 2/1983 Jennings ..... B23Q 11/08 144/242.1
4,432,538 A * 2/1984 Sequin ..... B25B 5/061 269/92
4,485,711 A 12/1984 Schnell
4,603,612 A 8/1986 Atkins
5,018,773 A 5/1991 Stavin et al.
5,678,467 A 10/1997 Aigner
5,875,827 A 3/1999 Brutscher et al.
6,135,521 A 10/2000 Wirth, Jr. et al.
6,732,623 B1 5/2004 Jennings
7,040,206 B2 5/2006 Wang
7,146,890 B1 12/2006 Rowe
7,540,224 B2 6/2009 Wang
7,886,641 B2 2/2011 Wirth, Jr. et al.
D665,638 S 8/2012 Krohmer et al.
2003/0051592 A1* 3/2003 Molburg ..... B23Q 9/0042 83/745
2006/0185485 A1* 8/2006 Wang ..... B27B 25/10 83/436.2
2009/0278296 A1* 11/2009 Fulcher ..... F41G 1/467 269/60

* cited by examiner

*Primary Examiner* — R. K. Arundale
*Assistant Examiner* — Maleshia Jones
(74) *Attorney, Agent, or Firm* — Robert L. Wolter; Beusse, Wolter, Sanks & Maire PLLC

(57) ABSTRACT

A heel member for a push block used with a woodworking apparatus comprises a side surface that is disposed substantially perpendicular to a bottom surface of the push block and is spaced apart from and end of the push block. A heel position adjustment mechanism is operatively connected to the heel member to adjust the heel member and a bottom edge of the heel member to multiple selected positions relative to a bottom surface of the push block. The heel member may have an inclined surface abutting an incline surface at the end of the push block and female and male guides along both inclined surfaces in mating relationship.

12 Claims, 10 Drawing Sheets

SELECTIVELY ADJUSTABLE HEEL MEMBER FOR A PUSH BLOCK AND A PUSH BLOCK WITH THE SAME

BACKGROUND OF THE INVENTION

This invention relates generally to the field of woodworking tools, and more particularly to push blocks that are used to advance or push a work piece past a cutting element of a wood working apparatus to cut the work piece.

Push blocks are devices that are used by operators of woodworking tools to advance, push or force a work piece past a cutting element of the woodworking tool to cut the work piece. Such push blocks typically have a body with a generally flat bottom surface that engages a surface of the work piece, e.g., a top horizontal surface. A heel member or surface is disposed perpendicular to the bottom surface of the push block and engages a trailing end of the work piece. A handle is provided for the operator to grasp and advance the work piece past the work piece the cutting element. The cutting apparatus typically has a guide rail that a side of the work piece abuts to advance the work piece in a straight line.

The heel members of many prior art push blocks are fixed and not adjustable and may not work well on work pieces of smaller or larger thicknesses. Prior art heel members that are adjustable are typically adjustable only between a position at which the heel member engages a top surface of a work piece and a position at which the heel member engages an end of a work piece. Again, such prior art heel members have similar shortcoming as to the fixed heel members in that they may not accommodate varying thicknesses of work pieces.

Accordingly, the below described selectively adjustable heel member for a push block can be adjusted to multiple positions relative to a bottom surface of the push block to accommodate work pieces of different thicknesses. To that end, the inventive heel member is configured to move between a retracted position on top of a work piece and a preselected. position to engage and end of a work piece.

BRIEF DESCRIPTION OF THE INVENTION

An apparatus for guiding a work piece past a cutting element comprises a main body portion having one or more generally flat bottom surfaces for engaging a surface of a work piece, a top surface, a first end and a second end. A handle is mounted to the top surface to grip and push the main body portion. A heel member is attached to the first end or second end of the main body portion, wherein the heel member has a side surface that is generally perpendicular to the one or more bottom surfaces of the main body portion. The heel member further includes a bottom edge that is generally parallel to the one or bottom surfaces of the main body portion. The apparatus also comprises a heel position adjustment mechanism operatively connected to the heel member and the first or second end of the main body portion wherein upon actuation of the heel position adjustment mechanism a position of the bottom edge of the heel member is selectively adjustable to a plurality of different positions relative to the one or bottom surfaces of the main body portion.

In an embodiment, the heel adjustment mechanism may comprise a fastener having a flange on a first end of a shaft and the flange is disposed within a keyway on the first or second end of the main body portion. The shaft extends through the spacer and heel member, and a second end of the shaft is threaded opposite or distal the flange. A knob is threaded engagement with the second end of the fastener shaft, and rotatable on the shaft. A biasing mechanism, such as a compression spring, is on the fastener shaft between the knob and fastener flange biasing the knob away from the heel member. In this manner, the knob is prevented from rotating further so the heel member will be held at a selected position. The heel member includes a slot through which the fastener shaft extends so the position of heel member is adjusted by moving the heel member relative to the fastener shaft along the slot.

BRIEF DESCRIPTION OF THE DRAWINGS

These and other advantages of the invention will become more apparent from the following description in view of the drawings. Similar structures illustrated in more than one figure are numbered consistently among the drawings.

DETAILED DESCRIPTION OF THE INVENTION

The inventor has developed a novel adjustable heel member for a woodworking push block. The heel member is selectively adjustable to multiple different positions relative to a bottom surface of the work piece to, for example, engage the ends of work pieces of varying thicknesses or to position the heel relative to the bottom of the push block at a desired position. In addition, a heel position adjustment mechanism is operatively connected to the heel member and the push block and is configured to allow the heel member to return to the same preselected position relative to the bottom of the push block when the push block is moved between positions wherein the heel member engages a top surface of the work position and the heel member engages an end of the work piece.

Figure 1:
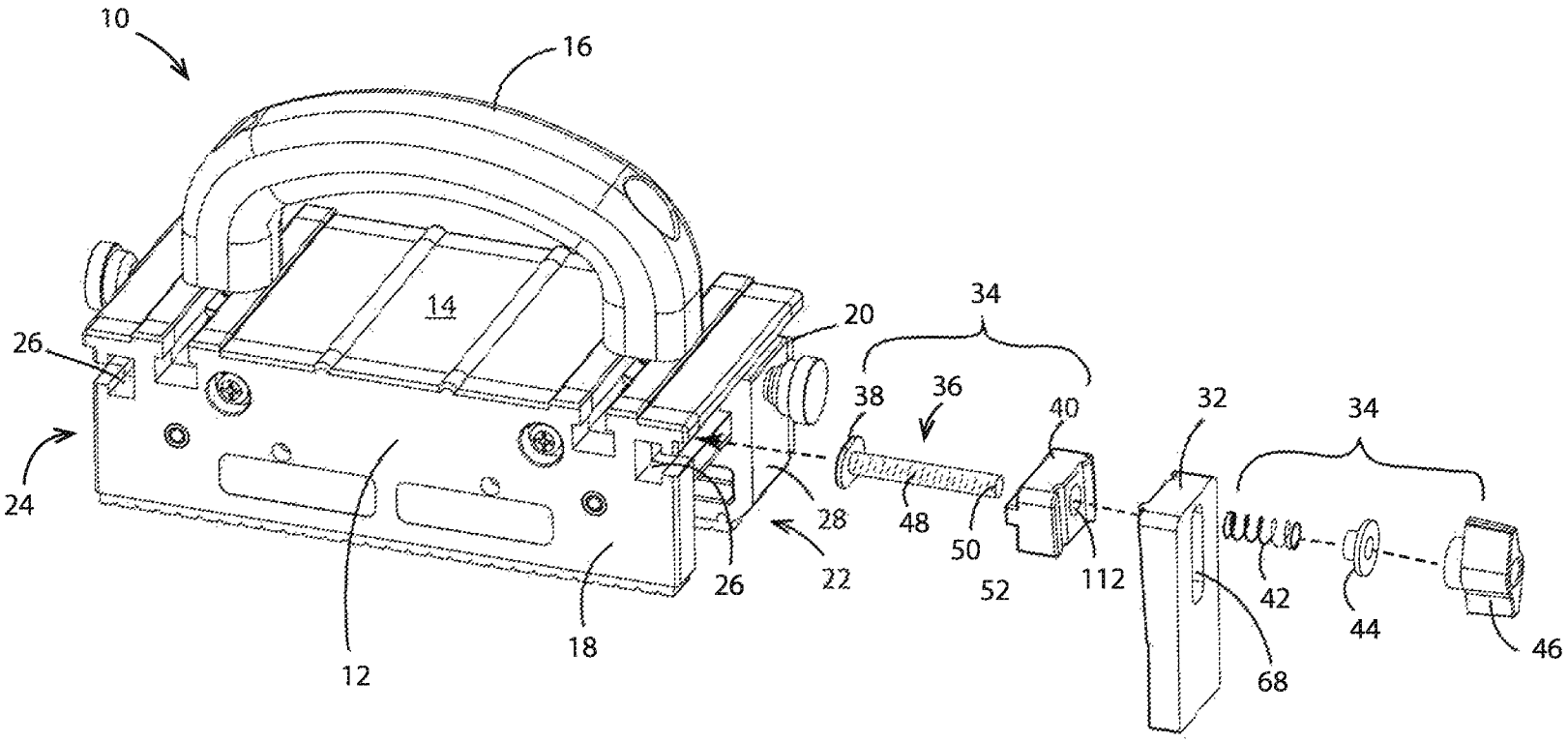
FIG. 1 is a perspective exploded view of an adjustable heel member with a push block in accordance with the present invention.

With respect to FIG. 1, a push block 10 is illustrated and is similar to the push block disclosed in U.S. Pat. No. 7,040,206, the content of which is incorporated herein in its entirety. As shown, the push block 10 includes a main body portion 12 that includes a top surface 14 on which a handle 16 is mounted to grip the push block 10 to advance the same and a work piece along a table of a cutting apparatus, such as a table saw, band saw or router. The main body portion 12 also includes two spaced apart legs 18, 20 for straddling a cutting element as the push block 10 is used to advance a work piece along a cutting apparatus.

Figure 2:
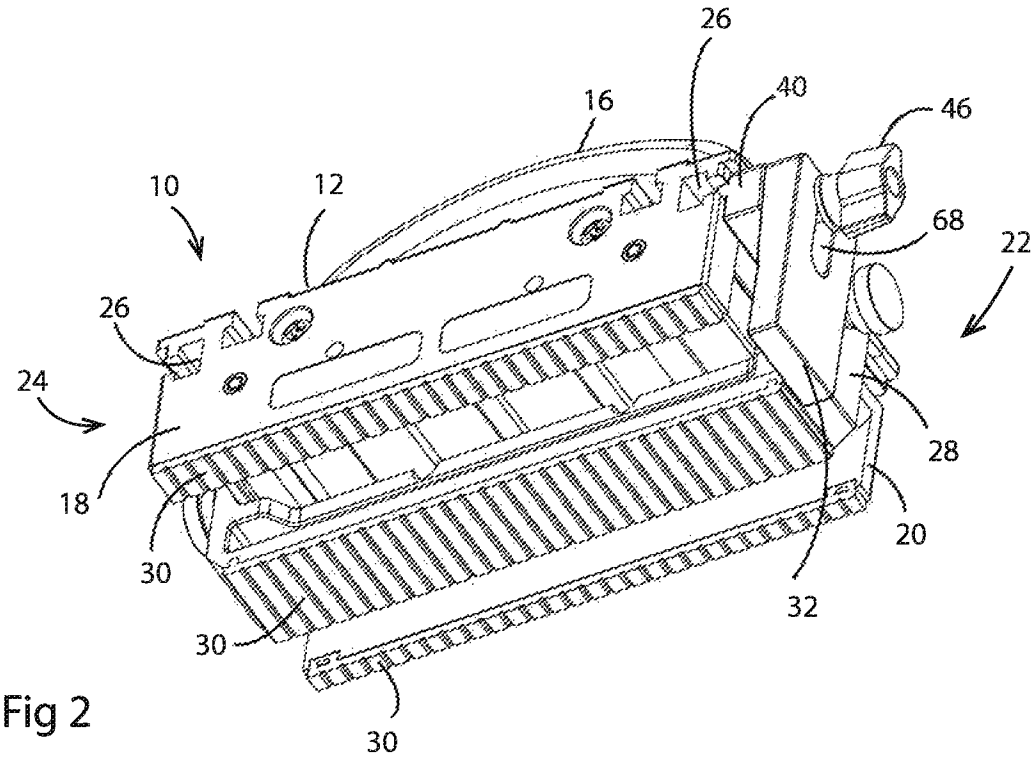
FIG. 2 is a bottom perspective view of the push block of FIG. 1.

The main body portion 12 may further include a first end 22 and second end 24 one or both of which may have a keyway or slot 26 for attachment of components to the main body portion 12. In an embodiment, the push block 10 may include a center leg 28 affixed to the first and second ends 22, 24 at the keyway 26. The center leg 28 is laterally adjustable on the main body portion 12 to adjust the width of one or more tunnels between the legs 18, 20. As shown in FIG. 2, the legs 18, 20 and center leg 28 form one or more bottom surfaces 30 of the main body portion 12. The bottom surface(s) 30 may include a non-slip pad to engage a surface of a work piece. While the inventive adjustable heel member is disclosed in reference to the above-described push block 10, the invention is not so limited and can be used with other types of push blocks, for example, push blocks that have a generally cuboidal shape with a single bottom surface to engage a surface of a work piece, or any other shape that may be incorporated into a push block. In addition, the push block and components of the push block including the below described adjustable heel member and some components of the heel position adjustment mechanism may be composed of a rigid plastic material, such as acrylonitrile butadiene styrene ("ABS").

Again with respect to FIG. 1, the heel member 32 and a heel position adjustment mechanism 34 are illustrated in an exploded view to see the heel member 32 and components of the heel position adjustment mechanism 34. The heel member 32 includes a side surface 70 (see, FIG. 6) that is spaced apart from the first end 22 or second 24 of the push block 10, depending on where the heel member 32 is mounted. In addition, the heel member 32 includes a bottom edge 72 whose position is selectively adjustable relative to the bottom surface(s) 30 of the main body portion to engage an end of a work piece or a top surface of a work piece.

As shown the heel position adjustment mechanism 34 may include a threaded fastener 36, a spacer 40, a biasing mechanism 42 such as a compression spring, a shoulder washer 44 and a threaded knob 46. The threaded fastener 36 includes a flange 38 that fits within keyway 26 and a shaft 48 with a threaded end 50 that extends through an aperture 112 in the spacer 40 and a slot 68 in the heel member 32. As further shown in FIGS. 1, 3, 4 and 6, the spacer 40 has one or more keys 52 disposed within keyway 26 so the spacer 40 and heel member 32 are selectively, laterally slidable along the first end 22 or second end 24 of the main body portion 12. While the heel position adjustment mechanism 34 is described with respect to the above-referenced components, the invention is not so limited and may include any such mechanism that facilitates the selective adjustment of the heel member 32 and bottom edge 72 thereof to a plurality of different positions relative to the bottom surface(s) 30 of a push block.

Figure 5A:
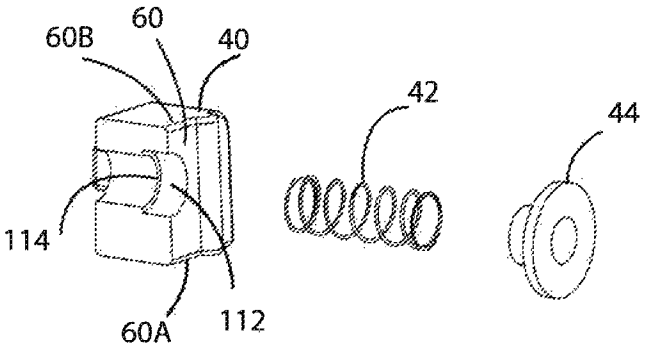
FIG. 5A is a partial sectional view of the spacer showing a surface a biasing mechanism abuts.

The biasing mechanism 42 is disposed on the shaft 48 of the fastener 36 and abuts the shoulder washer 44 at one end of the biasing mechanism 42 and a surface 114 (see, FIG. 5A) within the aperture 112 in the spacer 40 at the other end of the biasing mechanism 42. The knob 46 is threaded on to shaft 48 at the threaded end 50 thereof and is rotatable thereon to adjust position of the heel member 32 relative to the bottom surface(s) 30 of the push block 10. The biasing mechanism 42 biases the shoulder washer 44 against the knob 46 to hold the knob 46 at a selected position, and as will be explained in more detail allows the heel member 32 to move between a position that is flush against a surface of a work piece and a position in which the heel member is offset relative to the bottom surface(s) 30 of the main body portion 12.

Figure 3:
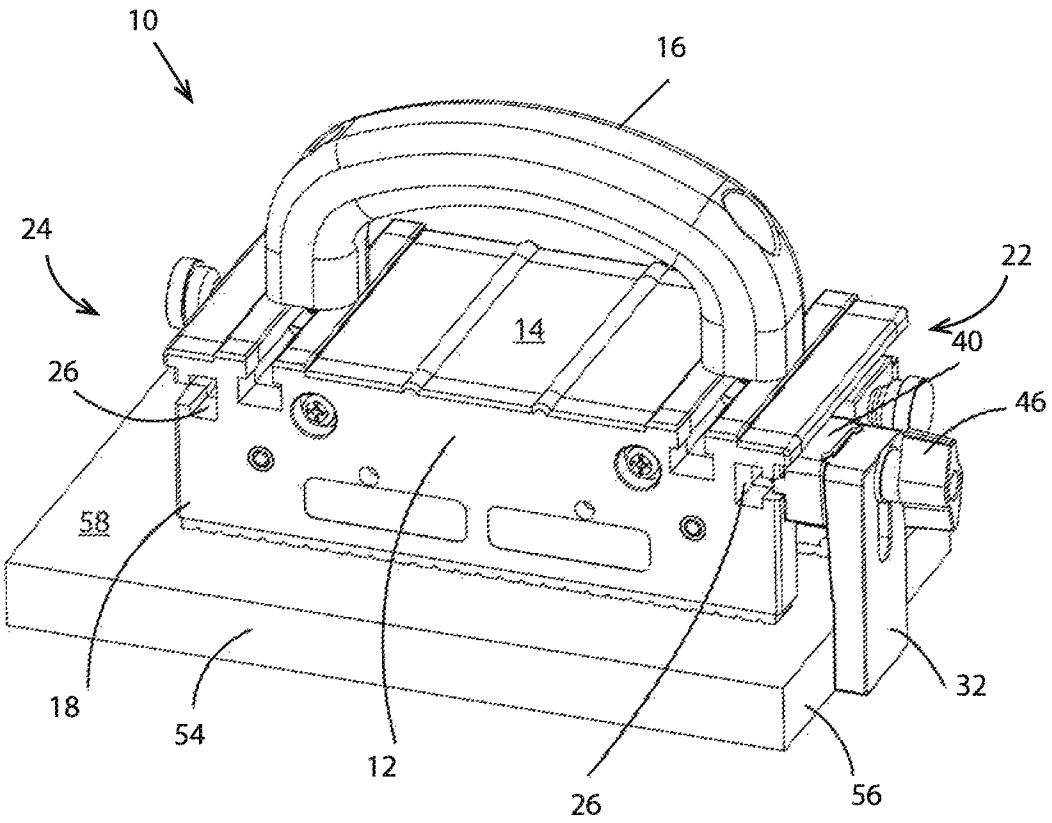
FIG. 3 is a perspective view of the push block of FIG. 1 on a work piece with the heel member adjusted to engage an end of the work piece.
Figure 4:
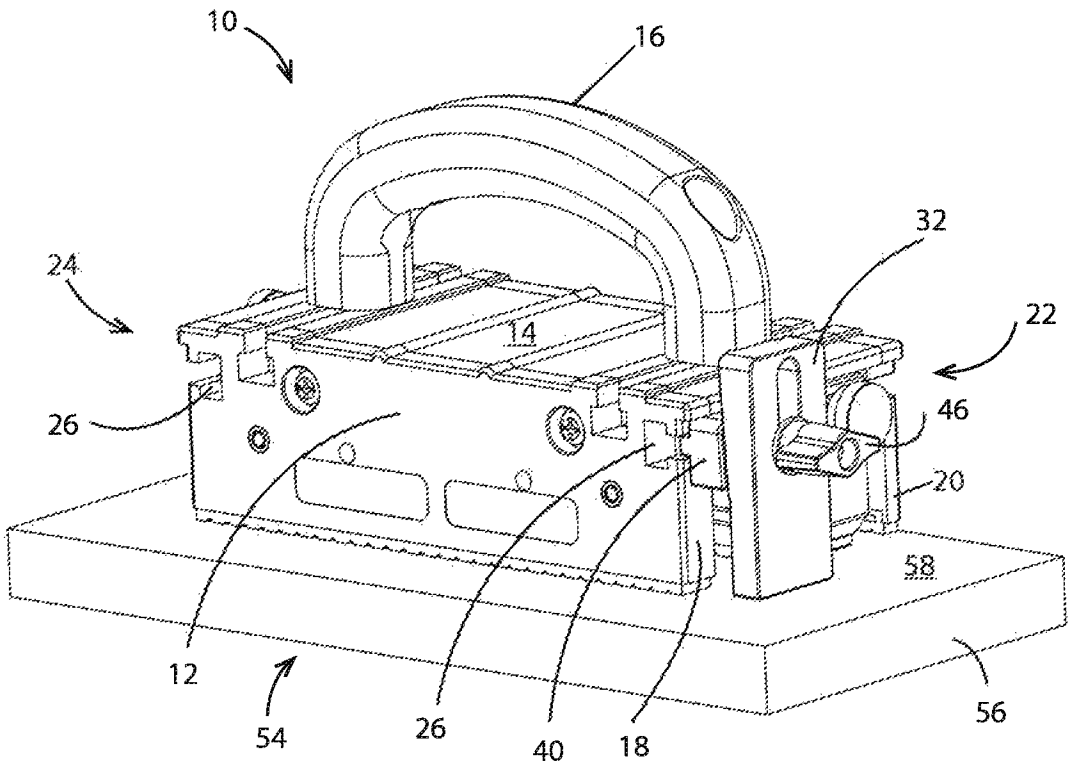
FIG. 4 is a perspective view of the push block of FIG. 1 on a work piece with the heel member adjusted to engage a top surface of the work piece.

To that end, heel member 32 has been adjusted downward to engage an end 56 of work piece 54 in FIG. 3. The knob 46 is tightened to fax the heel member 32 in position to engage the work piece end 56 to advance the work piece 54 along a table of a cutting apparatus (not shown). In reference to FIG. 4, the knob 46 has been adjusted so the heel member 32 engages a top surface 58 of the work piece 54. The push block 10 may be placed on top of the work piece 54 with heel member 32 engaging top surface 58 and the knob is tightened. In order to adjust the position of the heel member 32 to engage an end 56 of the work piece 54, the push block 10 is positioned toward the end 56. Then the knob 46 is slowly rotated so that heel member 32 will drop due to gravity until it is adjusted to a desired position to engage the end 56 of work piece 54. The biasing of compression spring 42 against the washer 44 prevents the knob 46 from rotating further, so the heel member 32 can move between a position flush against the top surface 58 of the work piece 54 to a position below the bottom surface(s) 30 to engage the end 56 of work piece 54.

Figure 5:
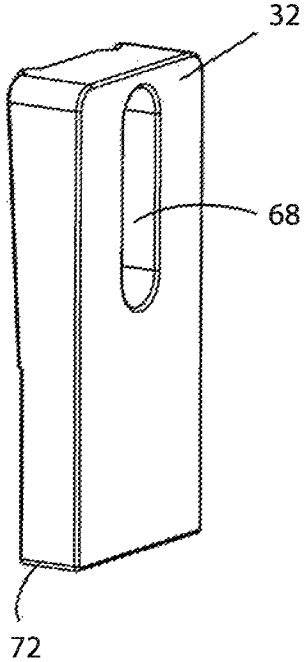
FIG. 5 is a first perspective view of the heel member and spacer showing a female and male protrusion guides on the spacer and an inclined surface of the spacer.
Figure 5:
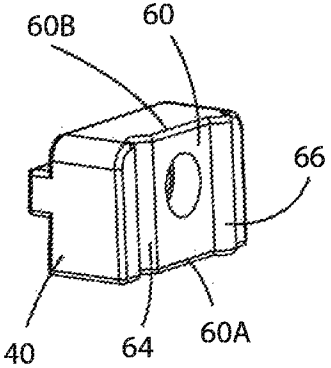
Figure 6:
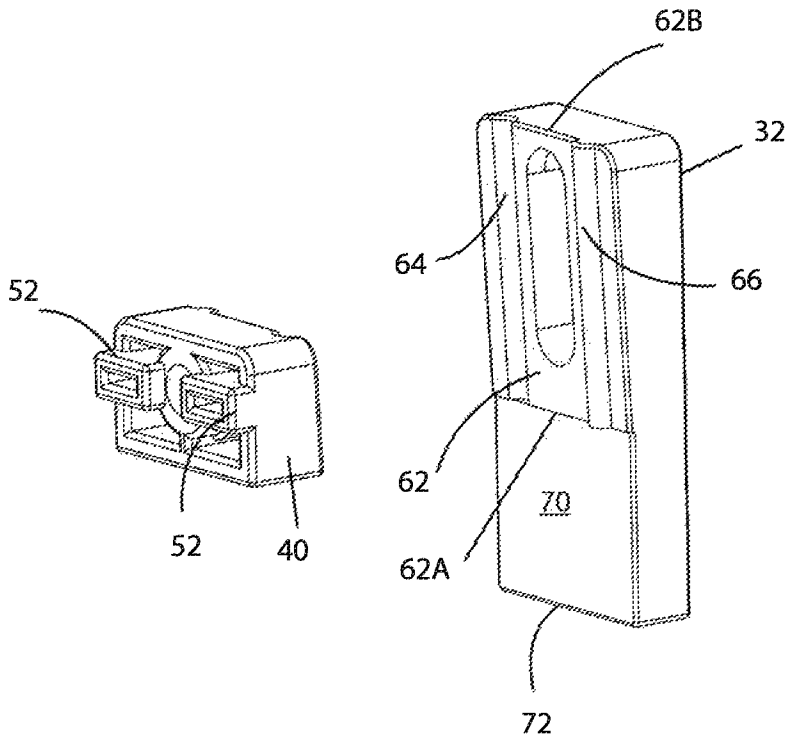
FIG. 6 is a second perspective view of the heel member and spacer showing the female and male guides on the heel member, and an inclined surface of the heel member.
Figure 7:
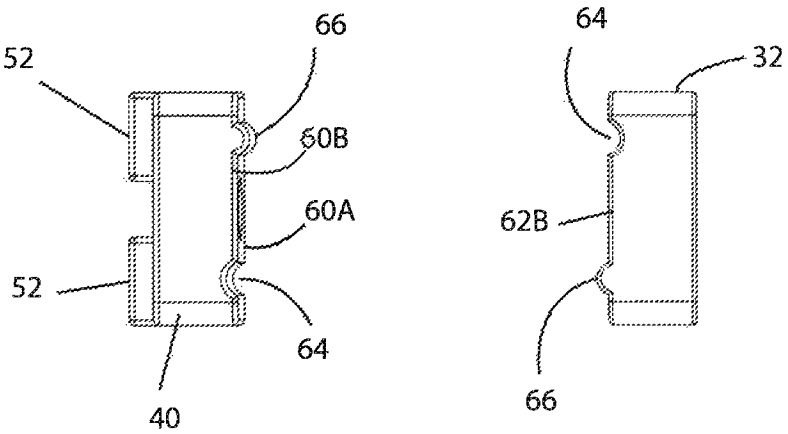
FIG. 7 is a top view of the spacer and heel member showing the female and male guides of each component.

In reference to FIGS. 5-7, the spacer 40 and heel member 32 are illustrated in more detail. More specifically, the interface between these two components that facilitates the selective adjustment of heel member 32 is shown. With respect to FIG. 5, the spacer 40 includes a first inclined surface 60 and with respect to FIG. 6, the heel member 32 includes a second inclined surface 62. Both surfaces 60, 62 are inclined in the same direction and to substantially the same degree so when mounted to the push block 10, the surfaces 60, 62 are abutting one another and substantially parallel. When mounted to the push block 10, the surfaces 60, 62 are inclined toward the push block 10 from a respective bottom edge 60A, 62A to a respective top edge 60B, 62B of surfaces 60, 62. In an embodiment, the surfaces are inclined at an angle of about 5° taken from vertical; however, the angle of the inclined surfaces may be greater or less than 5°, and the invention is not limited to this particular angle.

Figure 8:
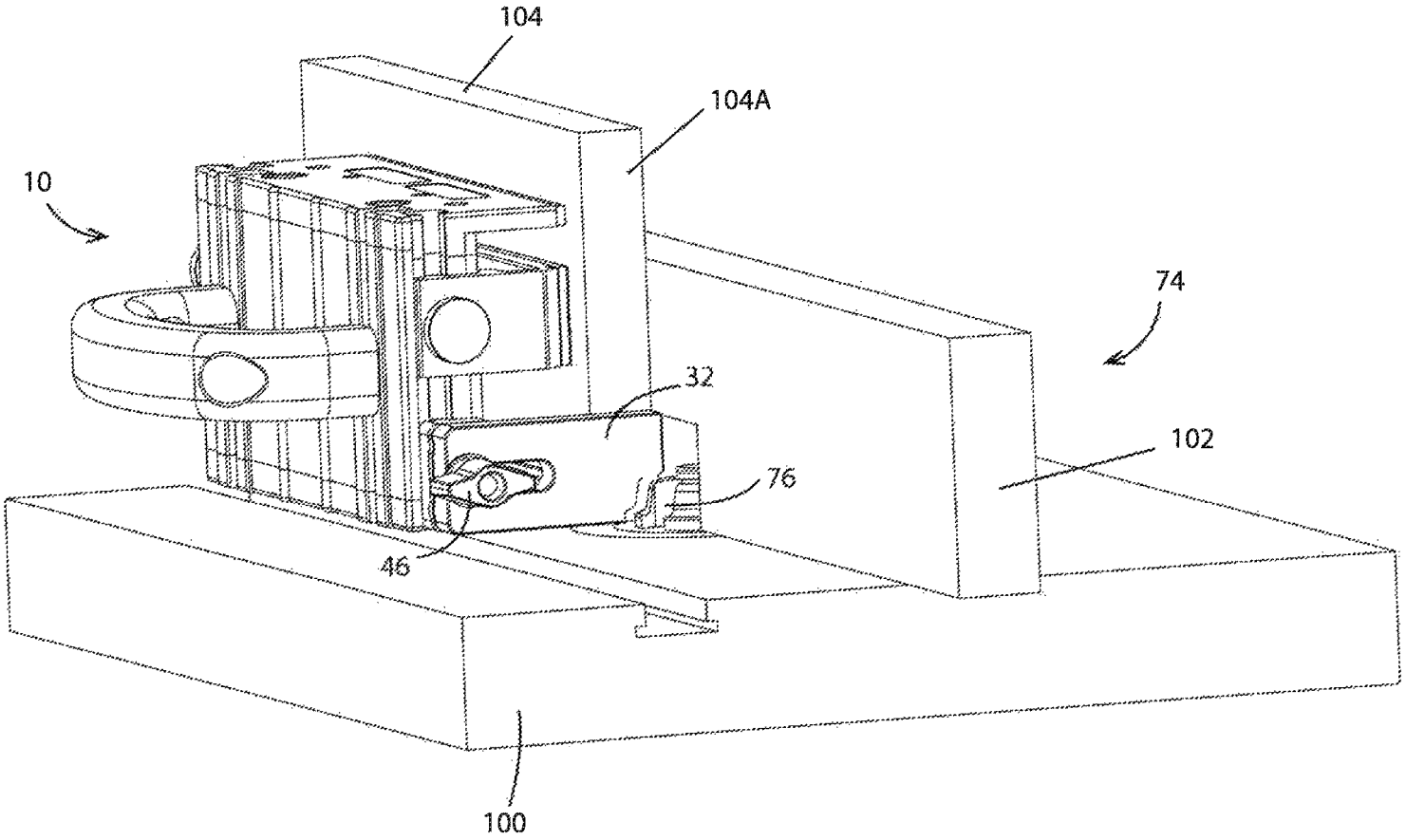
FIG. 8 is a perspective view of a push block engaging a work piece on a router with the heel adjusted to engage an end of the work piece.

In addition, female and male guides 64, 66 are positioned in mating relationship when the spacer 40 and heel member 32 are mounted to the push block 10. In this manner, the heel member 32 remains aligned so the bottom edge 72 of the heel member is substantially parallel to the bottom surface(s) 30 of the main body portion 12. As shown in FIG. 8, the push block 10 may be used with a router apparatus 74 with a router bit 76, table 100 and guide rail 102, in which case push block 10 and heel member 32 are positioned on their sides to engage work piece 104. However, the mating engagement of the female and male guides 64, 66 and the tightening of the knob 46, maintain the alignment of the bottom edge 72 of the heel member is substantially parallel to the bottom surface(s) 30 of the main body portion 12.

In use, the knob 46 is rotated to loosen the engagement between the heel member 32 and spacer 40, so the position of heel member 32, and consequently the bottom edge 72 of the heel member 32, can be adjusted to any one of a plurality of desired positions. As described above in reference to FIG. 3, the heel member 32 may be adjusted relative to the bottom surface(s) 30 of the main body portion 12 to engage an end 56 of work piece 54; and, in reference to FIG. 4, the position of the heel member 32 has been adjusted so the bottom edge 72 of the heel member 32 engage a top surface 58 of work piece 54.

Figure 9:
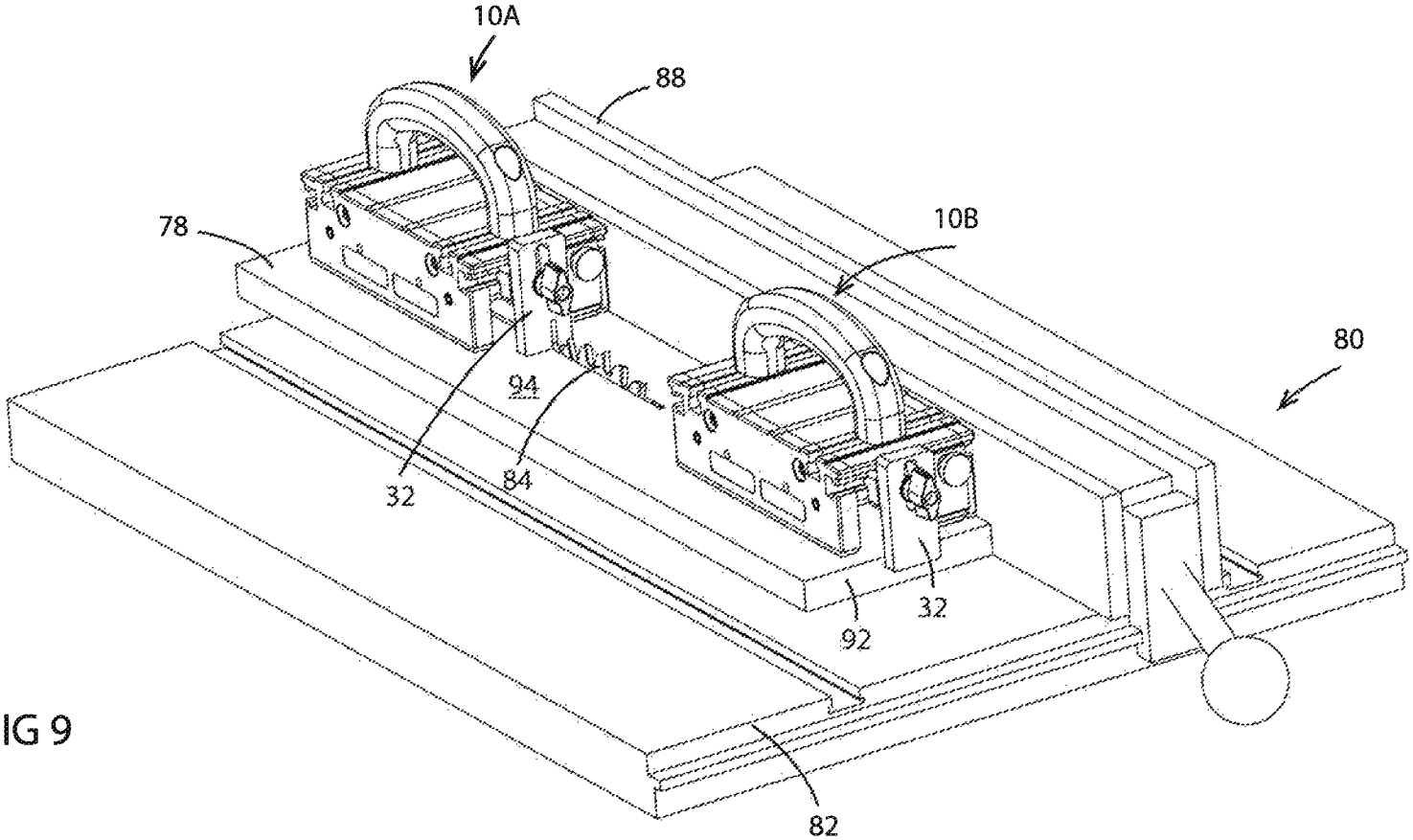
FIG. 9 is a perspective view of two push blocks with the inventive adjustable heel being used to advance a work piece on a cutting apparatus

With respect to FIG. 9, two push blocks 10A, 10B are shown in use to advance a relatively long work piece 78 on a cutting apparatus 80 including a table 82, cutting element 84 and guide rail 88. When cutting longer work pieces as shown in FIG. 9, it may be necessary to move the leading push block 10A to a trailing position as that of push block 10B to continue to advance the work piece 78 past the cutting element 84. Accordingly, the heel position adjustment mechanism 34 may be adjusted so the heel member 32 may move between a position when the heel member 32 engages a top surface of a work piece and a position when the heel member 32 engages an end of a work piece. In such a case, the heel position adjustment mechanism 34 may be adjusted so the heel member 32, when moving to an end or edge of a work piece, will drop to the same position. If the heel member 32 is allowed to drop too low it may catch the edge of the table 82 or drag along table creating a hazard or adversely affecting the cut of the work piece 78.

Figure 10C:
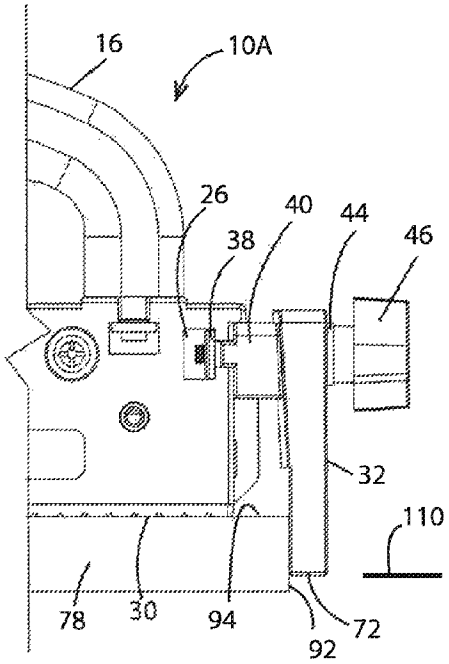
FIG. 10C is a side elevational view of the push block of FIGS. 10A and 10B moved back to the position of FIG. 10A with the adjustable heel engaging the same end of the work piece.
Figure 10B:
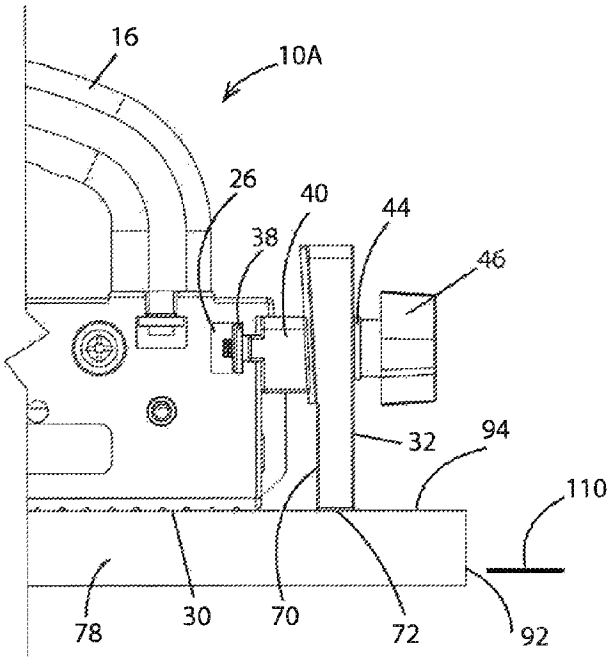
FIG. 10B is a side elevational view of the push block of FIG. 10A with the adjustable heel member engaging a top surface of the same work piece.
Figure 10A:
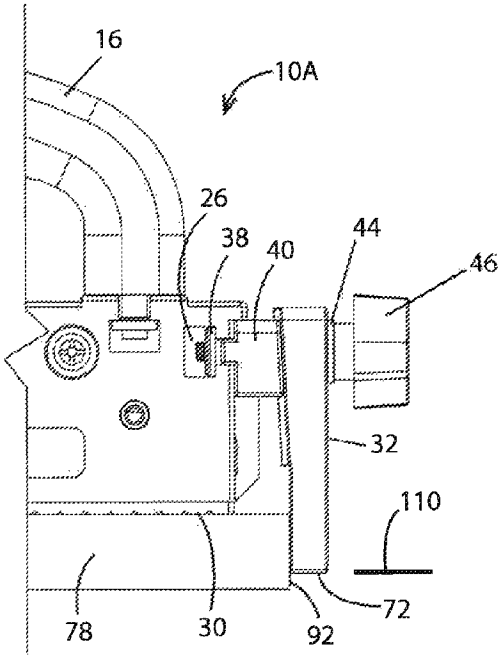
FIG. 10A is a side elevational of a push block with the inventive adjustable heel member engaging an end of a work piece.

If such replicated positioning of the heel member 32 is necessary, the heel member 32 is adjusted to a desired position as described above. As shown in FIG. 10A, the heel member 32 has been adjusted so side surface 70 engages an end 92 of work piece 78 and the bottom edge 72 of the heel member 32 has been moved to a preselected position indicated by line 110. In FIG. 10B, without the need of further adjustment, the push block 10 is positioned on the top 94 of the work piece 78 and the heel member 32 is in a retracted position engaging a top 94 of work piece 78. As shown in FIG. 10C, the push block 10A is moved back to the end 92 of the work piece 78, and the heel member 32 drops to the same position 110 as in FIG. 10A, without the need of actuating the heel position adjustment mechanism 34. That is, the heel adjustment mechanism 34 prevents the heel member 32 from dropping too low to adversely affect a cutting operation.

Other advantages of the selectively adjustable heel member 32 may be appreciated in reference to FIGS. 8 and 9 which show the heel member aligned with cutting elements 76, 84. Accordingly, the heel member 32 is composed of a material that can be cleanly cut by a cutting element, such as the above referenced ABS plastic material. With respect to FIG. 8, the heel member 32 and push block 10 are shown used in connection with a router 74. The push block 10, as described above, may include a non-slip pad forming bottom surface(s) of the push block 10 to advance the work piece 104 past a cutting element. In this configuration, the heel member 32 can be adjusted to engage the guide rail 102, the trailing edge 104A of the work piece 104 and the table 100, so the heel member 32 covers the entire thickness of the work piece 104. In this manner, as the trailing edge 104A and heel member 32 advance -past the router bit 76, the heel member 32 assists in minimizing or preventing splintering of the work piece 104 at its trailer edge 104A. Prior art push blocks that do not include a heel member, or a heel member that can't be cut, or a heel member that can't be adjusted to cover the entire thickness of the work piece at the cutting element, are not able to minimize or prevent such splintering. Such splintering can create an undesirable rough edge that may require an additional woodworking step of standing. However, the heel member 32 of the present invention can minimize or eliminate splintering and additional sanding steps.

As further shown in FIG. 9, the heel member 32 and push blocks 10A, 10B are shown used in connection with a cutting apparatus 80 such as a table saw 80. The push blocks 10A, 10B, as described above, may include a non-slip pad forming bottom surface(s) of the push block 10 to advance the work piece 78 past a cutting element. As shown, the heel member 32 is aligned with cutting element 84. Accordingly, as the push blocks 10A advances the work piece 78 and heel member 32 past the cutting element 84, the heel member 32 and the work piece 78 are cut into two pieces; however, the heel member 32 and bottom surface(s) 30 of the push block 10A, as shown, remain in contact with both pieces of the cut work piece 78. This contact maintains a force against both pieces of the cut work piece 78 to stabilize both pieces as the work piece 78 continues to be advanced. In this manner, the heel member 32 aids in minimizing vibrations of the two cut pieces. Such vibrating, if left uncontrolled, can adversely affect the cut and create a safety hazard. Prior art push blocks that include heel members, are typically placed to the right of the cutting element 84 shown in FIG. 9, and cannot maintain a force against the top surface of the two pieces that are formed from cutting a work piece. However, the heel member 32 positioned as shown in FIG. 9 can maintain contact with both pieces as the work piece is cut to minimize vibrating of the two pieces, creating a truer cut and minimizing risks associated with vibrations of these pieces.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

What is claimed is:

1. An apparatus for guiding a work piece past a cutting element, the apparatus comprising:

a main body portion having one or more generally flat bottom surfaces for engaging a surface of a work piece, a top surface, a first end and a second end;

a handle extending outward from the top surface of the main body portion;

a heel member attached to the first end or second end of the main body portion, wherein the heel member has a side surface that is generally perpendicular to the one or more bottom surfaces of the main body portion and the heel member further includes a bottom edge that is generally parallel to the one or bottom surfaces of the main body portion; and, a heel position adjustment mechanism operatively connected to the heel member and the first or second end of the main body portion, wherein the heel position adjustment mechanism comprises:

a spacer disposed between the side surface of the heel member and the first or second end of the main body and the heel member, and the spacer has a first inclined surface that is inclined from a bottom edge of the first inclined surface to a top edge of the first inclined surface toward the main body portion;

a fastener including a threaded shaft with a first end of the shaft connected to the first or second end of the main body and a second end, and the shaft extends through the spacer and the heel member;

a knob in threaded engagement with the second end of the fastener shaft, and rotatable on the shaft;

a biasing mechanism on the fastener shaft at least a portion of which is between the knob and the spacer biasing the knob away from the heel member, thereby enabling axial movement of the heel member along the threaded shaft between the spacer and the knob when the heel member is in a second position where the bottom edge is flush with the one or more bottom surfaces of the main body portion;

wherein the heel member includes a second inclined surface that is integral to and above the side surface of the heel member and the second inclined surface faces the first inclined surface, wherein movement of the first inclined surface along the second inclined surface adjusts an axial position and a vertical position of the heel element;

wherein the heel member is free to move vertically between the second position and a first position where the bottom edge is below the second position, and wherein changing a position of the knob changes a vertical location of the first position.

2. The apparatus of claim 1 wherein a first guide is disposed on the first inclined surface extending from a bottom edge to a top edge of the first inclined surface and, a second guide is disposed on the second inclined surface, and the first guide and the second guide cooperate in a male/female mating relationship.

3. The apparatus of claim 1 wherein the first or second end of the main body portion includes a slot within which a portion of the spacer is disposed in sliding engagement for lateral adjustment of the spacer and heel member along the first or second end of the main body portion and the lateral adjustment of the spacer and heel member is perpendicular to the vertical adjustment of the bottom edge of the heel member relative to the one or more bottom surfaces of the main body portion.

4. The apparatus of claim 1 wherein the heel member is composed of a material that can be cut by a cutting element of a cutting apparatus and the heel member is aligned with the cutting element to advance the work piece past the cutting element.

5. The apparatus of claim 1, wherein when the apparatus is upright, gravity biases the heel member toward the knob and the first position.

6. An apparatus for guiding a work piece past a cutting device, the apparatus comprising:

a main body portion having one or more generally flat bottom surfaces for engaging a surface of a work piece, a top surface, a first end and a second end;

a handle extending outward from the top surface of the main body portion;

a heel member attached to the first end or second end of the main body portion, wherein the heel member has a side surface facing the first or second end of the main body portion and that is generally perpendicular to the one or more bottom surfaces of the main body portion and the heel member further includes a bottom surface that is generally parallel to the one or more bottom surfaces of the main body portion; and, a heel position adjustment mechanism operatively connected to the heel member and the first or second end of the main body portion comprising:

a fastener having a first end and a second end and the first end is operatively connected to the first or second end of the main body portion;

a knob on the second end of the fastener and actuatable thereon;

a biasing mechanism on the fastener between the knob and the first end of the fastener biasing the knob away from the heel member, thereby enabling axial movement of the heel member along the fastener between the first or second end of the main body portion and the knob;

wherein when the apparatus is upright the bottom surface of the heel member is free to move vertically within a range of vertical positions, and wherein one end of the range of vertical positions is adjusted by actuating the knob.

7. The apparatus of claim 6 wherein the heel position adjustment mechanism further comprises a spacer mounted to the first or second end of the main body portion between the side surface of the heel member and the first or second end of the main body portion, and the heel member abuts the spacer.

8. The apparatus of claim 7 wherein the spacer includes a first inclined surface that is inclined from a bottom edge of the first inclined surface to a top edge of the first inclined surface toward the main body portion and the heel member includes a second inclined surface that faces the first inclined surface and is substantially parallel to the first inclined surface, wherein movement of the first inclined surface along the second inclined surface adjusts an axial position and a vertical position of the heel member.

9. The apparatus of claim 8 wherein the first and second inclined surfaces each have at least one pair of female and male guides in mating relationship, and the guides on the first inclined surface extend from the bottom edge of the first inclined surface to the top edge of the first inclined surface.

10. The apparatus of claim 6 wherein the heel member is composed of a material that can be cut by a cutting element of a cutting apparatus and the heel member is aligned with the cutting element to advance the work piece past the cutting element.

11. The apparatus of claim 6, wherein the knob is actuated to a fixed position whereby the heel member is adjusted to a first position that is the one end of the range of vertical positions where the bottom surface is offset relative to the one or more bottom surfaces of the main body portion and the side surface of the heel member is capable of engaging a trailing end of the work piece, and the heel member moves to a second position when the main body portion is placed on top of the work piece, wherein the bottom surface of the heel member contacts a top surface of the work piece and the bottom surface of the heel member is coplanar with the one or bottom surfaces of the main body portion, and the heel member drops to the first position when removed from the top of the work piece without further actuation of the knob.

12. The apparatus of claim 6 wherein the first or second end of the main body portion includes a slot within which a portion of the spacer is disposed in sliding engagement for lateral adjustment of the spacer and heel member along the first or second end of the main body portion and the lateral adjustment of the spacer and heel member is perpendicular to the vertical adjustment of a bottom edge of the heel member relative to the one or more bottom surfaces of the main body portion.

* * * * *